US007374432B2

(12) United States Patent
Koguchi et al.

(10) Patent No.: US 7,374,432 B2
(45) Date of Patent: May 20, 2008

(54) CONNECTOR

(75) Inventors: Yasuyuki Koguchi, Tokyo (JP); Isao Kojima, Tokyo (JP)

(73) Assignee: DDK Ltd., Tokyo (JP)

( * ) Notice: Subject to any disclaimer, the term of this patent is extended or adjusted under 35 U.S.C. 154(b) by 6 days.

(21) Appl. No.: 11/481,875

(22) Filed: Jul. 5, 2006

(65) Prior Publication Data

US 2006/0276061 A1 Dec. 7, 2006

(30) Foreign Application Priority Data

Jul. 6, 2005 (JP) ..... 2005-197133

(51) Int. Cl.
*H01R 9/09* (2006.01)

(52) U.S. Cl. ..... 439/74; 439/247

(58) Field of Classification Search ..... 439/74, 439/247, 248, 570

See application file for complete search history.

(56) References Cited

U.S. PATENT DOCUMENTS 4,334,732 A * 6/1982 Roeschlein et al. ..... 439/248
4,738,631 A * 4/1988 Takahashi et al. ..... 439/248
5,201,663 A * 4/1993 Kikuchi et al. ..... 439/83
5,259,779 A * 11/1993 Ooya et al. ..... 439/247
5,306,169 A * 4/1994 Fukushima et al. ..... 439/248
5,873,742 A * 2/1999 McHugh ..... 439/74
5,961,347 A * 10/1999 Hsu ..... 439/570
6,045,380 A * 4/2000 Hashimoto ..... 439/248
6,155,858 A * 12/2000 Ozawa et al. ..... 439/248
6,390,828 B1 * 5/2002 Yamaguchi et al. ..... 439/74
6,391,096 B1 5/2002 Waters et al.
2003/0115019 A1 6/2003 Doddek et al.
2006/0089018 A1 * 4/2006 Orita et al. ..... 439/74
2006/0128198 A1 * 6/2006 Koga ..... 439/247

FOREIGN PATENT DOCUMENTS

JP 2002-352908 12/2002
JP 2003-045525 2/2003

(Continued)

OTHER PUBLICATIONS

Bob Augenstein, "Outside Experts Monitor Status of Key Transformers", Transmission & Distribution World, May 2003, Primedia Bus. Magazines & Media Inc.

(Continued)

*Primary Examiner*—Gary F. Paumen
(74) *Attorney, Agent, or Firm*—Abelman, Frayne & Schwab

(57) ABSTRACT

A connector includes contacts and an insulator. Each contact includes a contact portion, a first fixed portion, an elastic portion substantially in the form of a crank, a second fixed portion and a connection portion. The insulator includes a fixation block to which the second fixed portions are fixed, and a movable housing to which the first fixed portions are fixed. The movable housing is fixed only to the contacts and held by the elastic portions in a floating condition away from the bottom surface of the fixation block. The fixation block has a wall for preventing short circuit when the connector is being mounted on a substrate. A floating amount of more than 0.7 mm can be achieved with a simple construction without causing short circuit with a substrate when the connector is being fitted with a mating connector and without causing any failed connection.

6 Claims, 4 Drawing Sheets

FOREIGN PATENT DOCUMENTS

JP 2004-063358 2/2004

OTHER PUBLICATIONS

Yann-Chang Huang, "A New Intelligent Approach to Fault Detection of Electric Power Transformers", approx. 2000.

Michel Duval, "A Review of Faults Detectable by Gas-in-Oil Analysis in Transformers", IEEE Electrical Insulation Magazine, May/Jun. 2002, vol. 18, No. 3.

Michel Duval & Alfonso Depablo, "Interpretation of Gas-in-oil Analysis Using New IEC Publication 60599 and IEC TC 10 Databases", IEEE, Mar./Apr. 2001, vol. 17, No. 2.

Vladimiro Miranda & Adriana Rosa Garcez Castro, "Improving the IEC Table for Transformer Failure Diagnosis with Knowledge Extraction From Neural Networks", IEEE, Oct. 5, vol.

Zhenyuan Wang, "Artificial Intelligence Applications in the Diagnosis of Power Transformer Incipient Faults", Aug. 2000, Blacksburg, VA.

Transformers Committee, "IEEE Guide for the Interpretation of Gases Generated in Oil-Immersed Transformers", Institute of Electrical & Electronics Engineers, Inc., NY, Jul. 1992.

"Mineral Oil-Impregnated Electrical Equipment in Service", Norme Internationale, CEI IEC 60599 2nd Edition 99-03, IEC 1999, Switzerland.

General Electrotechnical Engineering Standards Committee, "The Interpretation of the Analysis of Gases in Transformers and Other Oil-Filled Electrical Equipment in Service" 99.

* cited by examiner

CONNECTOR

BACKGROUND OF THE INVENTION

This invention relates to a connector for use in electric and electronic appliances such as car navigation systems and the like, and more particularly to a connector having a floating structure permitting the connector to be fitted with a mating connector even if there is some positional deviation therebetween.

In order to connect two substrates, in general, two connectors (for example, a plug connector and a receptacle connector) have been used. The two connectors each mainly includes a plurality of contacts and an insulator made of an electrically insulating material for arranging and holding the contacts. As the two connectors are connected to the substrates by soldering or the like, respectively, some positional deviation between the connectors may unavoidably occur. Consequently, either of the connectors has been of a floating construction to accommodate or cancel such a positional deviation in many cases.

Connectors having a floating construction have been disclosed in the following Patent Literatures 1 to 3, among which the Patent Literatures 2 and 3, incidentally, have been proposed by the assignee of the present application.

Patent Literature 1

According to the ABSTRACT of Japanese Patent Application Opened No. 2004-63,358, this prior art has an object to provide a floating electrical connector which is relatively simple and inexpensive to manufacture and achieves a greater floating displacement. The floating electrical connector includes a plurality of terminals obtained by working metal plates and held by an inner housing and an outer housing surrounding the inner housing around an axis in the connector fitting direction. The terminals each have a contact portion at one end held by the inner housing, a connection portion at the other end held by and extending from the outer housing, and a flexible portion formed between the contact portion and the connection portion. In this way, the inner housing is supported by the flexible portions of the terminals in a movable manner relative to the outer housing. In the floating electrical connector, the plurality of the terminals are arranged with plate surfaces of their metal plates being flush with one another, and the terminals are worked in their thickness direction so as to be curved to form flexible portions between the inner and outer housings and held by the inner and outer housings by integrally forming them by insert molding.

In connection with the above description, claim 1 of the Japanese Patent Application Opened No. 2004-63,358 recites a floating electrical connector including a plurality of terminals obtained by working metal plates and held by an inner housing and an outer housing surrounding the inner housing around an axis in the connector fitting direction, and the terminals each having a contact portion at one end held by the inner housing, a connection portion at the other end held by and extending from the outer housing, and a flexible portion formed between the contact portion and the connection portion, so that the inner housing is movable relative to the outer housing by means of the flexible portions of the terminals, wherein the plurality of terminals are arranged with plate surfaces of their metal plates being flush with one another, and the terminals are worked in their thickness direction so as to be curved to form flexible portions between the inner and outer housings and held by the inner and outer housings by integrally forming them by insert molding. Claim 2 recites that in the floating electrical connector described in claim 1, the flexible portions of the terminals have a width narrower than those of their contact portions and the connection portions. Claim 3 recites that in the floating electrical connector described in claim 1, the outer housing includes regulating members mounted thereon, which are adapted to abut against parts of the inner housing to regulate movements of the inner housing in the fitting direction of the connector. Claim 4 recites that in the floating electrical connector described in claim 3, the regulating members are made of a metal. Claim 5 recites that in the floating electrical connector described in claim 1 or 3, the inner housing includes fitting introducing protrusions for conducting a mating connector when it is being fitted with the connector. Claim 6 recites that in the floating electrical connector described in claim 1 or 2, the inner housing and the outer housing are connected by a jointing portion which is able to be disconnected. Claim 7 recites that in the floating electrical connector described in one of claim 1, 2, 3 and 6, the inner housing includes an arrangement wall linearly extending when viewed in the fitting direction of the connector, on which wall surface the contact portions of the terminals are arranged, and transverse legs located at both longitudinal ends of the arrangement wall and extending perpendicularly to the arrangement wall, and tips of the transverse legs are adapted to abut against the outer housing upon movement of the inner housing so that the tips form lateral direction regulating portions, the flexible portions of the terminals being positioned in the space between the arrangement wall and the outer housing.

Patent Literature 2

According to the ABSTRACT of Japanese Patent Application Opened No. 2003-45,525, this prior art has an object to provide a connector which is of a floating construction and able to position connection portions of contacts with a simple construction without increasing the number of parts. In a connector including contacts each having a contact portion adapted to contact a mating contact, a fixed portion to be fixed to a block, and a connection portion to be connected to a substrate, and the block for holding and fixing therein a required number of the contacts, the above object can be achieved by features in that the contacts each comprise an elastic portion having at least one meandering portion between the fixed portion and the connection portion, and the block is provided with a housing having a substantially box shape with a clearance relative to the outer dimension of the block and located on the side of the connection portions of the contacts, thereby enabling the positioning of the connection portions of the contacts in relation to the substrate and enabling also floating of the connector. Moreover, the contacts are each provided between the elastic portion and the connection portion with a fitting portion adapted to engage an inserting hole of the housing.

In connection with the above description, claim 1 of the Japanese Patent Application Opened No. 2003-45,525 recites a connector to be mounted on a substrate, including contacts each having a contact portion adapted to contact a mating contact, a fixed portion to be fixed to a block, and a connection portion to be connected to the substrate, and the block for holding and fixing a required number of the contacts, wherein the contacts each comprise an elastic portion having at least one meandering portion between the fixed portion and the connection portion, and the block is provided with a housing having a substantially box shape with a clearance relative to the outer dimension of the block and located on the side of the connection portions of the contacts, thereby enabling the positioning of the connection portions of the contacts in relation to the substrate and enabling the connector to be in floating condition. Claim 2 recites that in the connector described in claim 1, the housing having arm portions is formed on both sides in width direction with slits adjacent to the arm portions to provide elasticity to the arm portions for facilitating mounting of locking portions of the block onto the arm portions. Claim 3 recites that in the connector described in claim 2, the contacts are each provided between the elastic portion and the connection portion with a fitting portion adapted to engage an inserting hole of the housing.

Patent Literature 3

According to the ABSTRACT of Japanese Patent Application Opened No. 2002-352,908, this prior art has an object to provide a connector which is of a floating construction and able to position connection portions of contacts with a simple construction without increasing the number of parts. In a connector including contacts each having a contact portion adapted to contact a mating contact, a fixed portion to be fixed to a block, and a connection portion to be connected to a substrate, and the block for holding and fixing therein a required number of the contacts, the above object can be achieved by features in that the contacts each comprise an elastic portion between the fixed portion and the connection portion, and a housing is provided which has a substantially box shape with a clearance relative to the outer dimension of the block and located on the side of the connection portions of the contacts, thereby enabling the positioning of the connection portions of the contacts in relation to the substrate and enabling also floating of the connector. In order to facilitate the floating, the elastic portion of each of the contacts includes at least one meandering portion.

In connection with the above description, claim 1 of the Japanese Patent Application Opened No. 2002-352,908 recites a connector to be mounted on a substrate, including contacts each having a contact portion adapted to contact a mating connector, a fixed portion to be fixed to a block, and a connection portion to be connected to the substrate, and the block for holding and fixing a required number of the contacts, wherein the contacts each comprise an elastic portion between the fixed portion and the connection portion, and a housing is provided which has a substantially box shape with a clearance relative to the outer dimension of the block and located on the side of the connection portions of the contacts, thereby enabling the positioning of the connection portions of the contacts in relation to the substrate and enabling also floating of the connector. Claim 2 recites that in the connector described in claim 1, the elastic portion of each of contacts includes at least one meandering portion. Claim 3 recites that in the connector described in claim 2, a cross-shaped positioning portion is provided between the elastic portion and the connection portion of each of the contacts. Claim 4 recites that in the connector described in claim 3, the housing is provided with a required number of inserting grooves in the surface on the substrate connection side for inserting the contacts, between which inserting grooves there are provided plate-shaped members which are each provided with a protrusion on one side and a guide face on the other side, while an inclined face A and an inclined face B are provided contiguous to each of the guide faces, and an inclined portion is provided which is substantially perpendicular to and contiguous to the inclined face A. Claim 5 recites that in the connector described in claim 4, each of the contacts is installed into the housing by steps of first inserting the contact with the tip of the cross-shaped positioning portion along the guide face, then causing the tip to move along the inclined portion and the inclined face A toward the protrusion, further causing the tip to move along the inclined face B toward the protrusion, and causing the cross-shaped positioning portion to fall onto the protrusion and installed portion.

In the case that two substrates are connected to each other, two connectors (for example, a plug connector and a receptacle connector) are generally used. As the two connectors are connected to the substrates by soldering or the like, respectively, there would be a problem that unless accurate positioning means are taken, it will often become impossible to connect the connectors. If such accurate positioning means are taken, however, the cost of fabrication would go up unwillingly.

In order to make it possible to connect two connectors even if there is any deviation therebetween, one of the two connectors has been often configured to be supported in a floating condition so as to accommodate or cancel the deviation therebetween.

In the connectors disclosed in the Patent Literature 1, however, when the connectors have been fitted with each other, contacts of the floating connector would frequently contact a substrate to cause short circuit, resulting in defective or failed connection.

On the other hand, with the connectors disclosed in the Patent Literatures 2 and 3, the floating amounts are determined depending upon clearances at engaging portions of the two insulators so that more than 0.4 mm of floating amounts could not be achieved.

SUMMARY OF THE INVENTION

With the view to such problems of the prior art, it is an object of the invention to provide an improved connector ensuring a floating amount of more than 0.7 mm with a simple construction without causing short circuit with a substrate when the connector is being fitted with a mating connector and hence without causing any defective or failed connection.

The above object can be achieved by the connector 10 to be detachably fitted with a mating connector 80, including a plurality of contacts 16 and an insulator for arranging and holding the contacts 16 therein, wherein according to the invention the contacts 16 each comprise a contact portion 22 at one end adapted to contact the mating connector 80; a connection portion 30 at the other end to be connected to a substrate 90; and between the contact portion 22 and the connection portion 30, a first fixed portion 24, a second fixed portion 28 and an elastic portion 26 having elasticity; and the these portions being arranged in the order of the contact portion 22, the first fixed portion 24, the elastic portion 26, the second fixed portion 28 and the connection portion 30, and the elastic portion 26 being substantially in the form of a crank, and wherein the insulator comprises a fixation block 12 to which the second fixed portions 28 of the contacts are fixed, and a movable housing 14 to which the first fixed portions 24 of the contacts are fixed, and the movable housing 14 is fixed only to the contacts 16 and held by the elastic portions 26 of the contacts 16 in a floating condition away from the bottom surface of the fixation block 12. The fixation block 12 has a substantially U-shaped cross-section, and the movable housing 14 has a substantially inverted T-shaped cross-section.

The movable housing 14 is provided at each of its longitudinal ends with a protruding portion 32, and arranged on the fixation block 12 are fixing tabs 18 which are substantially U-shaped and to be connected to the substrate 90 so that the fixing tabs 18 engage the protruding portions 32 of the movable housing 14 to prevent the movable housing 14 from moving away from the fixation block 12.

Moreover, the fixation block 12 is provided on the side of the substrate 90 with a wall integrally with the fixation block 12 or as a separate part for preventing short circuit when the connector 10 is being mounted on the substrate 90.

Further, the elastic portion 26 of each of the contacts 16 is 1.0 to 5.0 mm in length, thereby increasing a floating amount of the movable housing 14. If the length of the elastic portion 26 is less than 1.0 mm, sufficient floating cannot be achieved. If it is more than 5.0 mm, it will make the connector bulky which does not comply with the requirement of miniaturization of the connector imposed by customers and the like.

As can be seen from the above description, the connector 10 according to the invention can bring about the following significant effects.

(1) According to the invention, the contacts 16 each comprise a contact portion 22 at one end adapted to contact the mating connector 80; a connection portion 30 at the other end to be connected to a substrate 90; and between the contact portion 22 and the connection portion 30, a first fixed portion 24, a second fixed portion 28 and an elastic portion 26 having elasticity; and the these portions being arranged in the order of the contact portion 22, the first fixed portion 24, the elastic portion 26, the second fixed portion 28 and the connection portion 30, and the elastic portion 26 being substantially in the form of a crank, and further the insulator comprises a fixation block 12 to which the second fixed portions 28 of the contacts are fixed, and a movable housing 14 to which the first fixed portions 24 of the contacts are fixed, and the movable housing 14 is fixed only to the contacts 16 and held by the elastic portions 26 of the contacts 16 in a floating condition away from the bottom surface of the fixation block 12. Therefore, the floating of the connector is possible with a simple construction and stable electrical connection can be accomplished by a sufficient floating amount more than 0.7 mm.

(2) According to the invention, the fixation block 12 has a substantially U-shaped cross-section, and the movable housing 14 has a substantially inverted T-shaped cross-section. Consequently, the movable housing 14 can be held relative to the fixation block 12 in a floating condition by means of the contacts 16, while the fixing tabs 18 can be fixed to the fixation block 12 to prevent the movable housing 14 from moving away from the fixation block 12.

(3) According to the invention, the movable housing 14 is provided at each of its longitudinal ends with a protruding portion 32, and arranged on the fixation block 12 are fixing tabs 18 which are substantially U-shaped and to be connected to the substrate 90 so that the fixing tabs 18 engage the protruding portions 32 of the movable housing 14 to prevent the movable housing 14 from moving away from the fixation block 12. Accordingly, the parts of the connector have plural functions to reduce the number of parts, and holding force for the connector to the substrate 90 can be increased. As the mating connector 80 can be removed from the connector 10 without causing the contacts 16 to be deformed, the connector 10 and the mating connector 80 can be repeatedly fitted with and removed from each other to provide a stable electric connection even after fitting and removing have been repeated many times.

(4) According to the invention, the fixation block 12 is provided on the side of the substrate 90 with a wall integrally with the fixation block 12 or as a separate part for preventing short circuit when the connector 10 is being mounted on the substrate 90. Therefore, when the connector 10 is being mounted on the substrate, the elastic portions 26 of the contacts 16 do not contact the substrate 90 so that short circuit upon the connector being mounted on the substrate can be prevented and hence any defective or failed connection can be avoided.

(5) The elastic portion 26 of each of the contacts 16 is 1.0 to 5.0 mm in length, thereby increasing a floating amount of the movable housing 14. Consequently, even if the positional deviation between the connector and the mating connector is as large as 0.7 mm, such a positional deviation can be sufficiently accommodated or canceled, resulting in stable electrical connection.

The invention will be more fully understood by referring to the following detailed specification and claims taken in connection with the appended drawings.

DESCRIPTION OF THE PREFERRED EMBODIMENTS

Figure 1A:
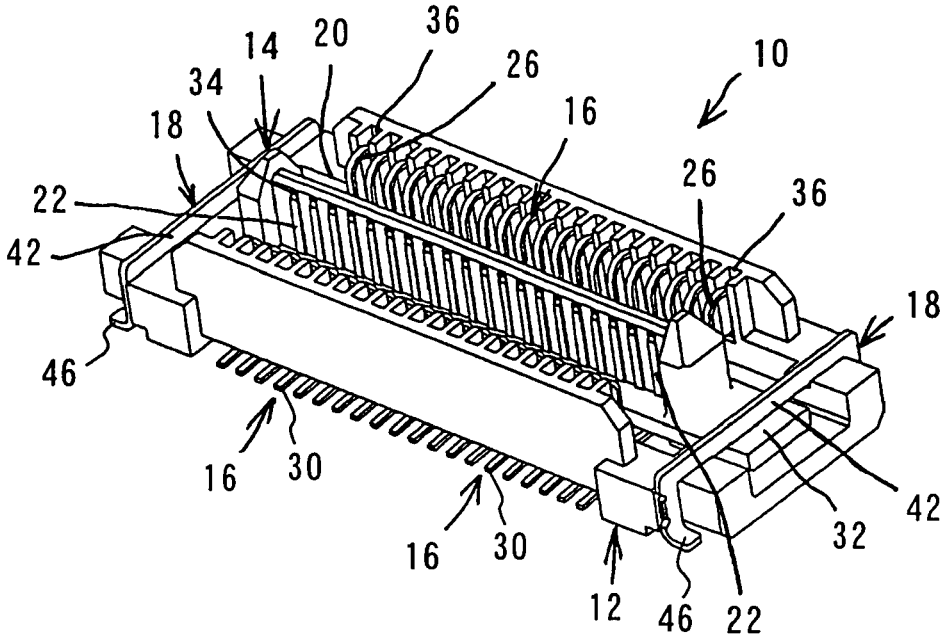
FIG. 1A is a perspective view of the connector according to the invention viewed from the fitting opening side.
Figure 1B:
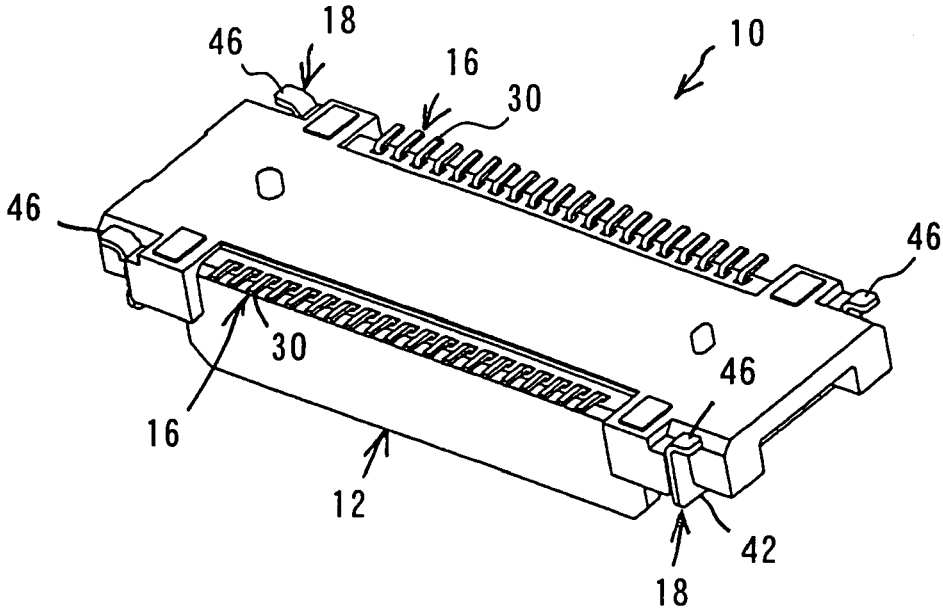
FIG. 1B is a perspective view of the connector according to the invention viewed from the substrate connection side.
Figure 2A:
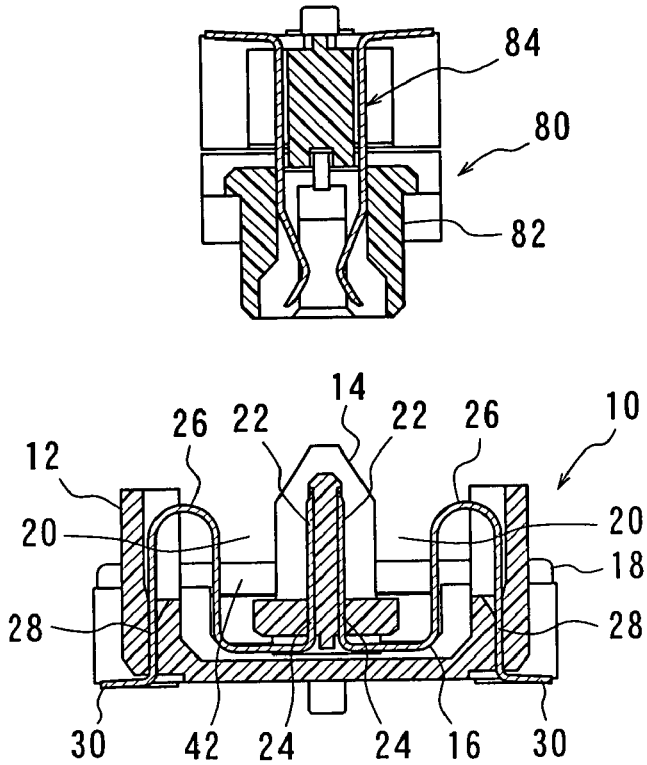
FIG. 2A is a cross-sectional view of a mating connector and the connector according to the invention.
Figure 2B:
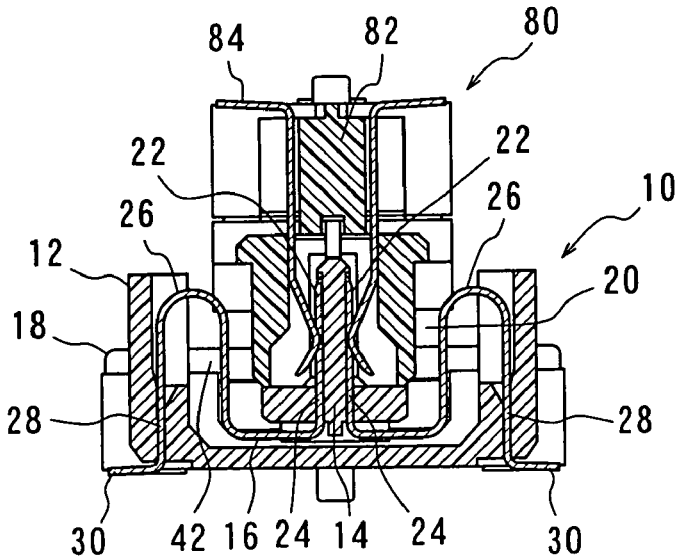
FIG. 2B is a cross-sectional view of the mating connector and the connector fitted with each other.
Figure 3A:
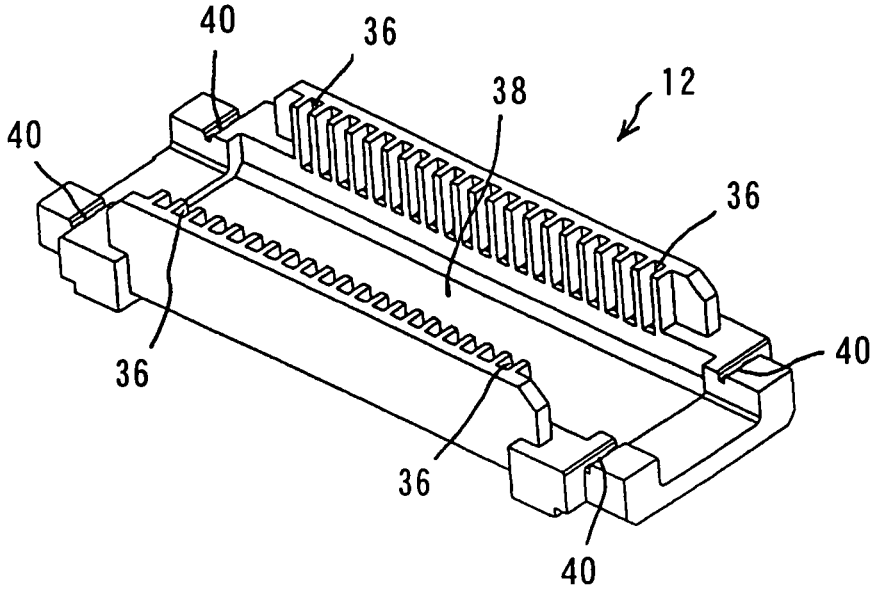
FIG. 3A is a perspective view of a fixation block viewed from the fitting opening side.
Figure 3B:
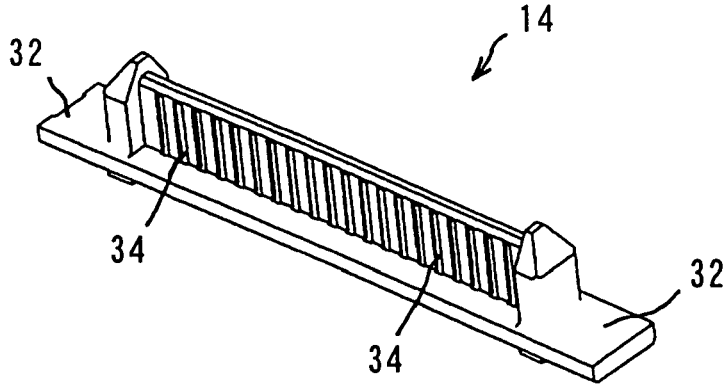
FIG. 3B is a perspective view of a movable housing viewed from the fitting opening side.
Figure 4:
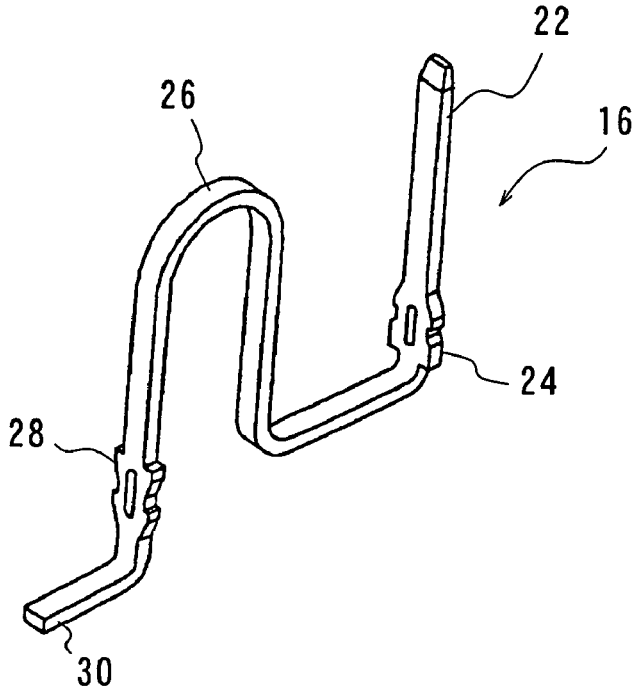
FIG. 4 is a perspective view of a contact.
Figure 5:
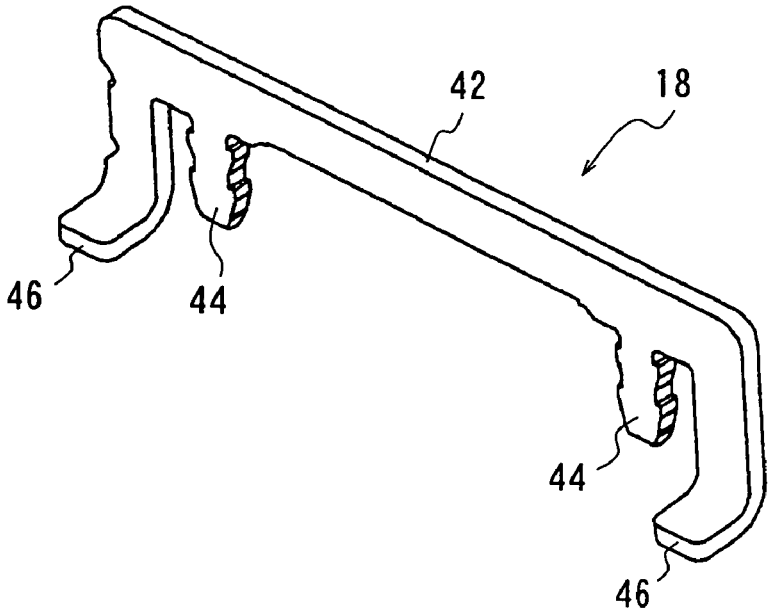
FIG. 5 is a perspective view of a fixing tab.

One embodiment of the connector according to the invention will be explained with reference to FIGS. 1 to 5. FIG. 1A is a perspective view of the connector according to the invention viewed from the fitting opening side. FIG. 1B is a perspective view of the connector according to the invention viewed from the substrate connection side. FIG. 2A is a cross-sectional view of the connector according to the invention and a mating connector. FIG. 2B is a cross-sectional view of the connector according to the invention fitted with the mating connector. FIG. 3A is a perspective view of fixation block viewed from the fitting opening side. FIG. 3B is a perspective view of a movable housing viewed from the fitting opening side. FIG. 4 is a perspective view of a contact. FIG. 5 is a perspective view of a fixing tab.

The connector 10 according to the invention mainly comprises a fixation block 12, a movable housing 14, contacts 16, and fixing tabs 18.

Before explaining the components of the connector according to the invention, a mating connector 80 will be explained. The mating connector 80 mainly comprises an insulator 82 and contacts 84 arranged in and held by the insulator 82. The mating connector 80 may be a connector connected to cables or to a substrate. However, since the connector 10 according to the invention is of a floating construction, the mating connector will be used to be connected to a substrate in many cases. In other words, the connector 10 according to the invention and the mating connector 80 are in general used for connecting between two substrates. As shown in FIGS. 2A and 2B, the connector 10 according to the invention and the mating connector 80 are connected to substrates, respectively, and under such a condition they are fitted with each other to perform exchange of signals between the substrates.

The components of the connector according to the invention will now be explained with reference to the drawings. First, the contacts 16 will be explained, which are subject features of the invention. The contacts 16 are made of a metal and formed by means of the press-working of the known technique. Preferred metals from which to form the contacts 16 include brass, beryllium copper, phosphor bronze and the like which comply with the requirements such as springiness, electric conductivity and the like.

Each of the contacts 16 is substantially U-shaped as shown in FIG. 4 and comprises a contact portion 22 at one end adapted to contact a contact 84 of the mating connector 80 and a connection portion 30 at the other end to be connected to a substrate. Between the contact portion 22 and the connection portion 30, it is provided a first fixed portion 24 to be fixed to the movable housing 14, an elastic portion 26 having elasticity, and a second fixed portion 28 to be fixed to the fixation block 12.

The first fixed portions 24 are fixed to the movable housing 14 on both the sides by means of press-fitting, hooking (lancing), welding or the like such that the contact portions 22 extend in the fitting opening 20. In order to easily bring the contact portions 22 into contact with the contacts 84 of the mating connector 80, the contact portion 22 of the contact 16 is projecting into the contact opening 20.

The second fixed portions 28 are fixed into the fixation block 12 by means of press-fitting, hooking (lancing), welding or the like. In this manner, the contacts 16 are fixed to the fixation block 12 such that the connection portions 30 extend onto the both side of the width direction of the connector. The connection portions 30 are of the surface mounting type (SMT) as shown in FIG. 2A, but they may be of the dip type.

The elastic portions 26 of the contacts 16 have the elasticity as described above so that even if the connector 10 somewhat deviates from or is misaligned with the mating connector 80, the elasticity of the elastic portions 26 serves to accommodate such a deviation between the two connectors. The shape of the elastic portions 26 may be any one insofar as it has the elasticity and thus such a function. Preferably the elastic portion 26 is substantially in the form of a "crank" in consideration of the miniaturization of the connector and fitting ability with a mating connector 80.

The length of the elastic portion 26 of the contact 16 is 1.0 to 5.0 mm in the illustrated embodiment. Such a length enables an amount of floating to be increased. If it is less than 1.0 mm, sufficient floating cannot be achieved. If it is more than 5.0 mm, it will make the connector bulky which does not comply with the requirement of miniaturization of the connector imposed by customers and the like.

In the case of 3.0 mm in length of an elastic portion 26, it achieves floating amounts of 0.7 mm in the longitudinal direction (direction of rows of the contacts) and 0.7 mm in the width direction. In the case of 4.0 mm in length, it achieves floating amounts of 0.8 mm in the longitudinal direction (direction of rows of the contacts) and 0.8 mm in the width direction. Moreover, in the case of 5.0 mm in length, it achieves floating amounts of 0.9 mm in the longitudinal direction (direction of rows of the contacts) and 0.9 mm in the width direction.

The movable housing 14 will then be explained, which is one of the subject features of the invention. The movable housing 14 is formed from an electrically insulating plastic material by means of the injection molding of the known technique. The material for the movable housing 14 may be suitably selected from plastic materials including polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The movable housing 14 is provided with inserting holes 34 on both sides of its longitudinal axis for fixing a required number of the contacts 16 with their first fixed portions 24 fixed thereto, respectively. The movable housing 14 has a substantially inverted T-shaped cross-section and supported by the contacts 16 in a floating condition away from the bottom of the fixation block 12 with the aid of the elasticity of their elastic portions 26. In other words, the movable housing 14 is held in the floating condition so that the movable housing 14 is displaceable in the longitudinal direction (direction of rows of the contacts) and in the width direction.

The movable housing 14 is provided on each of its longitudinal ends with a protruding portion 32. When the mating connector 80 is removed from the connector 10, the protruding portions 32 engage the fixing tabs 18, thereby preventing the movable housing 14 from moving in the direction removing the mating connector 80 and hence from moving away from the fixation block 12. The positional relation between the protruding portions 32 and the fixing tabs 18 may be suitably designed so as not to cause the deformation of the elastic portions 26 of the contacts 14 when the mating connector 80 is being removed from the connector 10.

The fixation block 12 is preferably provided on the side of the substrate 90 with a wall (not shown) for preventing any short circuit when the connector is mounted on the substrate 90. The wall may be provided on the fixation block 12 integrally therewith or as a separate part so long as the short circuit is prevented when the connector is mounted on the substrate.

The fixation block 12 will be explained. The fixation block 12 is formed from an electrically insulating plastic material by means of the injection molding of the known technique. The material for the fixation block 12 may be suitably selected from materials including polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The fixation block 12 is provided with inserting grooves 36 on both ends in its width direction for fixing the required number of the contacts 16 whose second fixed portions 28 are fixed in the inserting grooves as described above. The fixation block 12 has a substantially U-shaped cross-section. In the recess 38 formed by the U-shaped cross-section, the movable housing 14 is held in a floating condition as described above. A fitting opening 20 for the mating connector 80 is formed by the recess 38 and the movable housing 14.

The fixation block 12 is formed in each of its longitudinal ends with a fixing groove 40 for fixing the fixing tab 18 (FIG. 3A). Positions and shape of the fixing grooves 40 may be suitably designed such that when the mating connector 80 is being removed, the protruding portions 32 of the movable housing 14 engage the fixing tabs 18 to prevent the movable housing 14 from moving in the direction removing the mating connector 80 (to prevent the deformation of the elastic portions 26 of the contacts 14).

The fixing tabs 18 will then be explained with reference to FIG. 5. When the mating connector 80 is being removed from the connector 10, the fixing tabs 18 engage the protruding portions 32 of the movable housing 14 to prevent the movable housing 14 from moving in the direction removing the mating connector 80 (to prevent the deformation of the elastic portions 26 of the contacts 14). So long as such functions can be achieved, the fixing tabs 18 may be made of a metal or an electrically insulating plastic material. Preferred metals from which to form the fixing tabs 18 include brass, beryllium copper, phosphor bronze and the like which comply with the requirements such as dimensional stability, workability, strength and the like. If an electrically insulating plastic material is used for the fixing tabs 18, the material may be suitably selected including polybutylene terephthalate (PBT), polyamide (66PA or 46PA), liquid crystal polymer (LCP), polycarbonate (PC) and the like and combination thereof in consideration of dimensional stability, workability, manufacturing cost, strength and the like. In the illustrated embodiment, the fixing tabs 18 are made of liquid crystal polymer (LCP) in consideration of strength and heat resistance.

Each of the fixing tabs 18 is substantially in the form of a U-shape and mainly comprises an anchoring portion 42 adapted to engage the protruding portion 32 of the movable housing 14, fixed portions 44 to be fixed to the fixation block 12, and connection portions 46 to be fixed to a substrate. The fixing tabs 18 are fixed to the fixation block 12 by means of press-fitting, welding, or the like. The shape and size of the fixing tabs 18 may be suitably designed such that upon removal of the mating connector 80 from the connector 10, the fixing tabs 18 engage the protruding portions 32 of the movable housing 14 to restrict the movement of the floating movable housing 14 from moving in the direction removing the mating connector 80 so as to prevent the deformation of the elastic portions 26 of the contacts 14.

Examples of applications of the invention are connectors for use in electric and electronic appliances such as car navigation systems and the like, and particularly a connector having a floating structure permitting the connector to be fitted with a mating connector even if there is any positional deviation therebetween.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector to be detachably fitted with a mating connector, including a plurality of contacts and an insulator for arranging and holding said contacts therein, wherein said contacts each comprise a contact portion at one end adapted to contact said mating connector; a connection portion at the other end to be connected to a substrate; and between said contact portion and said connection portion, a first fixed portion, a second fixed portion and an elastic portion having elasticity are provided; and said these portions being arranged in the order of the contact portion, the first fixed portion, the elastic portion, the second fixed portion and the connection portion, and said elastic portion being substantially in the form of a crank, and wherein said insulator comprises a fixation block to which said second fixed portions of said contacts are fixed and a floating movable housing to which said first fixed portions of said contacts are fixed, and said movable housing is fixed only to said contacts and held by said elastic portions of said contacts in a floating manner away from a bottom surface of said fixation block, wherein said movable housing is provided at each of its longitudinal ends with a protruding portion, and arranged on said fixation block are fixing tabs which are substantially U-shaped and to be connected to the substrate so tat said fixing tabs engage said protruding portions of the movable housing to restrict movement of the movable housing from moving away from said fixation block when the mating connector is disengaged.

2. The connector as set forth in claim 1, wherein said fixation block has a substantially U-shaped cross-section, and said movable housing has a substantially inverted T-shaped cross-section.

3. The connector as set forth in claim 2, wherein said elastic portion of each of said contacts is 1.0 to 5.0 mm in length, thereby increasing a floating amount of the movable housing.

4. The connector as set forth in claim 1, wherein said elastic portion of each of said contacts is 1.0 to 5.0 mm in length, thereby increasing a floating amount of the movable housing.

5. A connector to be detachably fitted with a mating connector, including a plurality of contacts and an insulator for arranging and holding said contacts therein, wherein said contacts each comprise a contact portion at one end adapted to contact said mating connector; a connection portion at the other end to be connected to a substrate; and between said contact portion and said connection portion, a first fixed portion, a second fixed portion and an elastic portion having elasticity are provided; and said these portions being arranged in the order of the contact portion, the first fixed portion, the elastic portion, the second fixed portion and the connection portion, and said elastic portion being substantially in the form of a crank, wherein said insulator comprises a fixation block to which said second fixed portions of said contacts are fixed and a floating movable housing to which said first fixed portions of said contacts are fixed, and said movable housing is fixed only to said contacts and held by said elastic portions of said contacts in a floating manner away from a bottom surface of said fixation block, wherein said fixation block has a substantially U-shaped cross-section, and said movable housing has a substantially inverted T-shaped cross-section, and wherein said movable housing is provided at each of its longitudinal ends with a protruding portion, and arranged on said fixation block are fixing tabs which are substantially U-shaped and to be connected to the substrate so that said fixing tabs engage said protruding portions of the movable housing to restrict movement of the movable housing from moving away from said fixation block when the mating connector is disengaged.

6. The connector as set forth in claim 5, wherein said elastic portion of each of said contacts is 1.0 to 5.0 mm in length, thereby increasing a floating amount of the movable housing.

* * * * *